US008919071B2

(12) United States Patent
Vanker et al.

(10) Patent No.: US 8,919,071 B2
(45) Date of Patent: Dec. 30, 2014

(54) TRUSS CONFIGURATION

(71) Applicants: John Louis Vanker, Lac du Flameau, WI (US); Michael J. Lastowski, Centennial, CO (US)

(72) Inventors: John Louis Vanker, Lac du Flameau, WI (US); Michael J. Lastowski, Centennial, CO (US)

(73) Assignee: Patco, LLC, Denver, CO (US)

( * ) Notice: Subject to any disclaimer, the term of this patent is extended or adjusted under 35 U.S.C. 154(b) by 0 days.

(21) Appl. No.: 14/133,151

(22) Filed: Dec. 18, 2013

(65) Prior Publication Data

US 2014/0165496 A1 Jun. 19, 2014

Related U.S. Application Data

(60) Provisional application No. 61/739,217, filed on Dec. 19, 2012.

(51) Int. Cl.

| | |
|---|---|
| ***E04C 3/02*** | (2006.01) |
| ***E04C 3/30*** | (2006.01) |
| ***E04H 12/00*** | (2006.01) |
| ***E04C 3/08*** | (2006.01) |
| *E04C 3/07* | (2006.01) |
| *E04C 3/04* | (2006.01) |

(52) U.S. Cl.

CPC ... *E04C 3/08* (2013.01); *E04C 3/07* (2013.01); *E04C 2003/0473* (2013.01); *E04C 2003/0491* (2013.01)

USPC ..... 52/693; 52/692

(58) Field of Classification Search

CPC ..... E04C 3/04; E04C 3/07; E04C 3/08; E04C 3/09; E04C 3/16; E04C 2003/0473; E04C 2003/0486; E04C 2003/0491

USPC ..... 52/690, 692–694

See application file for complete search history.

(56) References Cited

U.S. PATENT DOCUMENTS

| | | | | |
|---|---|---|---|---|
| 4,833,841 | A * | 5/1989 | Ellington, III | 52/79.1 |
| 4,863,189 | A * | 9/1989 | Lindsay | 280/789 |
| 4,878,323 | A | 11/1989 | Nelson | |
| 5,781,953 | A * | 7/1998 | Winter | 14/69.5 |
| 6,993,881 | B1 * | 2/2006 | Ruble et al. | 52/692 |
| 8,141,318 | B2 * | 3/2012 | Dunbar et al. | 52/636 |
| 2002/0007611 | A1 * | 1/2002 | Sanford et al. | 52/694 |
| 2002/0046534 | A1 * | 4/2002 | Heinly et al. | 52/693 |
| 2003/0061780 | A1 * | 4/2003 | Masterson et al. | 52/702 |

(Continued)

FOREIGN PATENT DOCUMENTS

| | | | |
|---|---|---|---|
| GB | 670909 | A | 4/1952 |
| WO | 02-01016 | A1 | 3/2002 |

OTHER PUBLICATIONS

International Search Report of PCT/US2013/076399 mailed Apr. 10, 2014.

*Primary Examiner* — Brian Glessner
*Assistant Examiner* — Brian D Mattei
(74) *Attorney, Agent, or Firm* — HolzerIPLaw, PC

(57) ABSTRACT

An implementation of a truss configuration disclosed herein includes a plurality of trusses, each including a top chord, a bottom chord, a plurality of exterior braces, and a plurality of interior braces, wherein length of each of the plurality of exterior braces is substantially similar and wherein the angle between each of the exterior braces and the top chord is substantially similar. Furthermore, length of each of the plurality of interior braces is substantially similar and wherein the angle between each of the alternate interior braces and the top chord is substantially similar.

16 Claims, 10 Drawing Sheets

(56) References Cited

U.S. PATENT DOCUMENTS

| | | | | |
|---|---|---|---|---|
| 2004/0074195 | A1* | 4/2004 | Schmerber | 52/690 |
| 2004/0107660 | A1* | 6/2004 | Moreau | 52/336 |
| 2004/0118072 | A1* | 6/2004 | Collins | 52/639 |
| 2005/0229528 | A1 | 10/2005 | Kardosz et al. | |
| 2006/0053726 | A1 | 3/2006 | Reynolds et al. | |
| 2006/0053732 | A1* | 3/2006 | Watson et al. | 52/693 |
| 2007/0245675 | A1* | 10/2007 | Masterson et al. | 52/634 |

* cited by examiner

TRUSS CONFIGURATION

CROSS-REFERENCE TO RELATED APPLICATIONS

This application is a Non-Provisional patent application of and claims benefit of U.S. Provisional Application Ser. No. 61/739,217 entitled "Truss Configuration," and filed on Dec. 19, 2012, which is incorporated herein by reference in their entirety.

TECHNICAL FIELD

The invention relates to building construction components and, more particularly, to truss components used in commercial and residential structures.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Other features, details, utilities, and advantages of the claimed subject matter will be apparent from the following more particular written Detailed Description of various implementations and implementations as further illustrated in the accompanying drawings and defined in the appended claims.

The present application discloses a standardized open web truss. An implementation of a truss configuration disclosed herein includes a plurality of trusses, each including a top chord, a bottom chord, a plurality of exterior braces, and a plurality of interior braces, wherein length of each of the plurality of exterior braces is substantially similar and wherein the angle between each of the exterior braces and the top chord is substantially similar. Furthermore, length of each of the plurality of interior braces is substantially similar and wherein the angle between each of the alternate interior braces and the top chord is substantially similar.

BRIEF DESCRIPTIONS OF THE DRAWINGS

DETAILED DESCRIPTIONS

Figure 1:
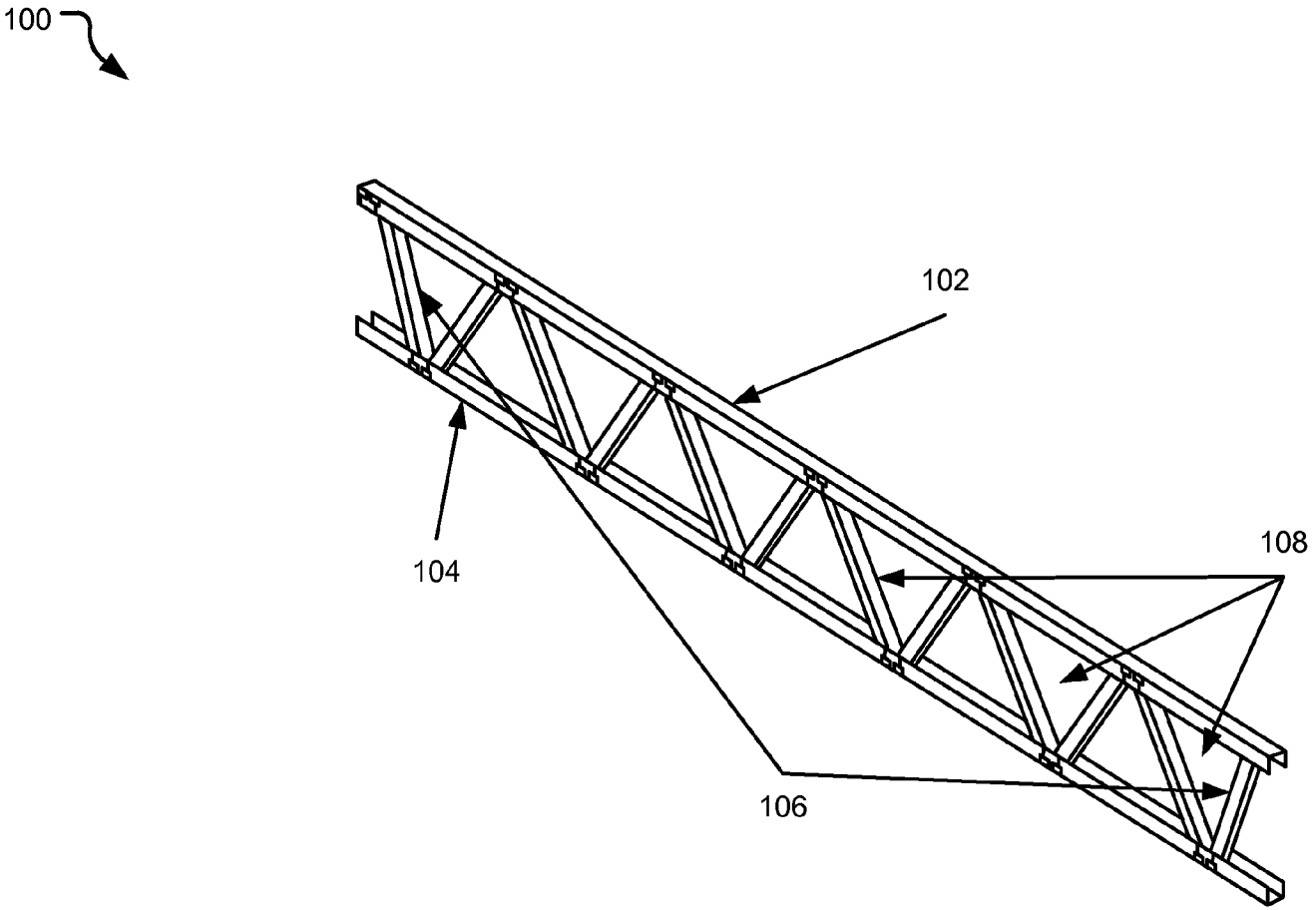
FIG. 1 illustrates an example three-dimensional view of an example truss.

Trusses are used in the construction of residential and commercial buildings to provide support for decking such as roof sheathing and flooring. The upper and lower portions of the truss are known as the "chords" and the members that extend between the chords are called "braces." Trusses used in residential structures are constructed from wood. However, due to the rising costs of lumber and its vulnerability to fire and insect damage, rotting, etc. many homebuilders are now turning to steel as the framing material of choice. Indeed, steel framing materials are rapidly gaining acceptance among homebuilders and homeowners alike due to their cost effectiveness, dimensional stability, non-combustibility, insect resistance, durability, high strength-to-weight ratio and recycleability, etc.

An implementation of truss disclosed herein provides truss configuration using standardized components. Furthermore, a method of manufacturing the truss from cold rolled galvanized steel is also disclosed herein. Specifically, the standardization of various components of the truss and their arrangement in the truss configuration allows for manufacturing of the truss using cold roller machines. In the implementations disclosed herein, the lengths, depth, angles of connection, etc., are standardized. Such standardization reduces the need for repeated engineering design and analysis of the trusses. Furthermore, the standardization also reduces the costs of manufacturing the truss. The truss disclosed herein may be used to support floor and/or ceiling spans of a building.

An implementation of a method of manufacturing a truss disclosed herein comprises roll-forming a top chord, roll-forming a bottom chord, roll-forming a plurality of exterior braces, roll-forming a plurality of interior braces, punching pilot holes in the top chord and the bottom chord, cutting welding slots in the top chord and the bottom chord, connecting one or more of the plurality of the exterior braces to the top chord and to the bottom chord via the pilot holes and the welding slots, and connecting one or more of the plurality of the interior braces to the top chord and to the bottom chord via the pilot holes and the welding slots.

In an alternative implementation, connecting one or more of the plurality of the interior braces to the top chord further comprises connecting each of the adjacent of the plurality of the interior braces to the top chord at a substantially similar angle. Yet alternatively, connecting one or more of the plurality of the interior braces to the top chord further comprises connecting each of the adjacent of the plurality of the interior braces to the top chord at a substantially similar distance from each other.

Furthermore, the implementations disclosed herein also disclose a chord comprising a first flange having an inner end and an outer end with a first lip at the inner end of the first flange, a second flange having an inner end and an outer end with a second lip at the inner end of the second flange, and a web connected to the outer end of the first flange and the outer end of the second flange and extending between the first flange and the second flange. The chord may be used as bottom chord of a truss or as a top chord of a truss.

FIG. 1 illustrates a three-dimensional view of an example truss 100. The truss 100 includes a top chord 102, a bottom chord 104, various exterior braces 106, and various interior braces 108. In one implementation of the truss, the top chord 102 and the bottom chord 104 are parallel to each other. Each of the exterior braces 106 is of a length substantially similar to each of other. Similarly, each of the interior braces 108 is also of a length that is substantially similar to each other. In one implementation, the angles between the interior braches 108 and the top chord 102 as well as the angles between the interior braches 108 and the bottom chord 104 may also be standardized. For example, the angles between each of the alternate interior braces and the top chord may be substantially similar. Similarly, the angles between each of the alternate interior braces and the bottom chord may also be substantially similar.

Each of the top chord, bottom chord, the interior braces, and the exterior braces may be formed from galvanized steel such as cold rolled galvanized steel using cold roller machines. For example, for manufacturing an interior brace, a roll of galvanized cold steel is cut to a predetermined length equaling the length of an interior brace. Subsequently, the cut length of the cold rolled steel is formed into the shape of an interior brace to include two side flanges connected by a web.

Figure 2:
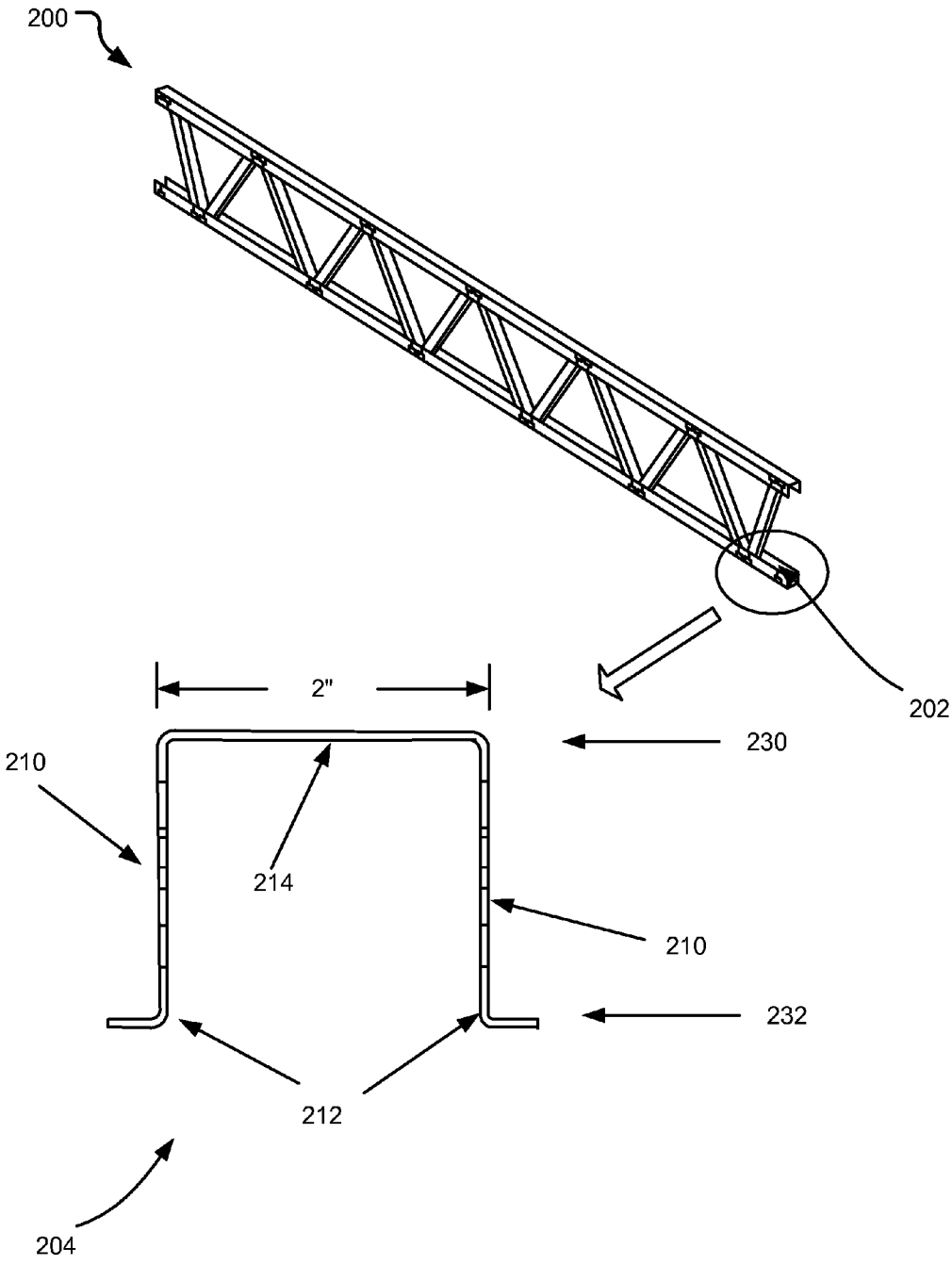
FIG. 2 illustrates an example cross-sectional view of an example chord used in the truss of FIG. 1.

FIG. 2 illustrates a cross-sectional view 204 of an example chord 202 used in the truss 200. Specifically, the chord 202 is a bottom chord that is attached to a top chord via various interior braces and exterior braces. The implementation of the chord 202 includes two flanges 210 that are connected to each other via a web 214. In one implementation, the flanges 210 are connected to the web 214 at an outer end 230 of the flanges 210 Furthermore, each of the two flanges 210 has a lip 212 at an inner end 232 of the flanges 210. The outer end 232 of the flanges 210 faces the inside of a truss configuration made of a bottom flange, a top flange, and braces. The outer end 230 of the flanges 210 faces connects to the web 214, which faces outside of a truss configuration made of a bottom flange, a top flange, and braces.

In the illustrated example, the width of each of the flanges 210 and the web 214 is two inches. However, in an alternative implementation, other width for these elements may be provided. The two-inch web 214 gives a greater surface area to attach structural floor diaphragms to the web 214.

Furthermore, in the illustrated implementation, the thickness of the lips 212 is ¼ inches. However, alternative thickness for the lips 212 may be provided in other implementations. The ¼ inch lips 212 resist the lateral and/or out of plane deflection and torsion, thus eliminating the need for blocking to connect joist to joist that is typical when "C" joists or other trusses are used to prevent the twisting of the joists.

Figure 3:
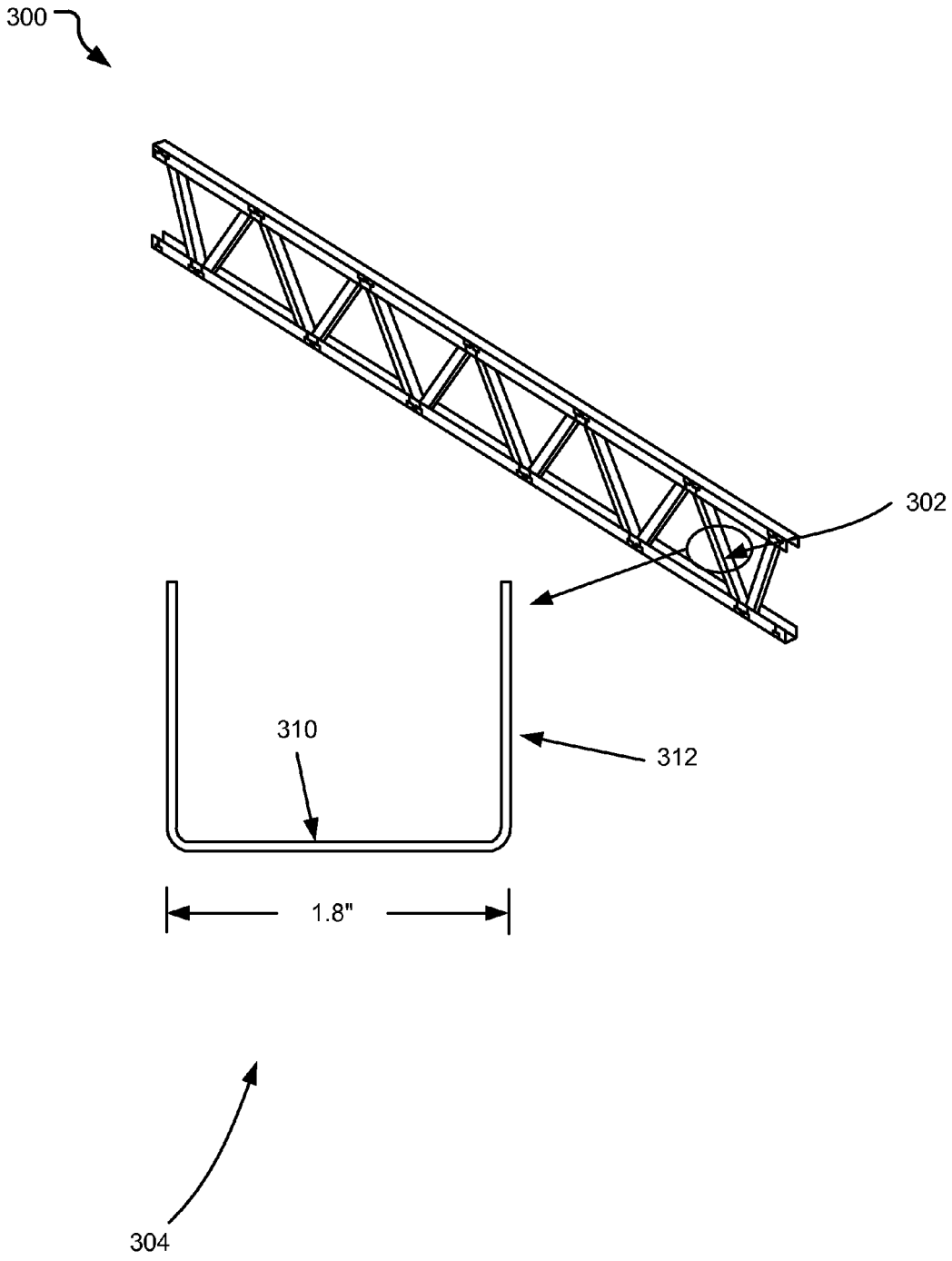
FIG. 3 illustrates an example cross-sectional view of an example brace used in the truss of FIG. 1.

FIG. 3 illustrates a cross-sectional view 304 of an example brace 302 used in the truss 300. Specifically, the brace 302 includes a web 310 with a width of 1.8 inches and two flanges 312 having width of 1.5 inches. The width of the web 310 is such that the brace 302 can be fitted inside the webs of top chord and bottom chord. While the brace 302 is shown to be an interior brace, a similar structure may be used to form an exterior brace for the truss 300.

Figure 4:
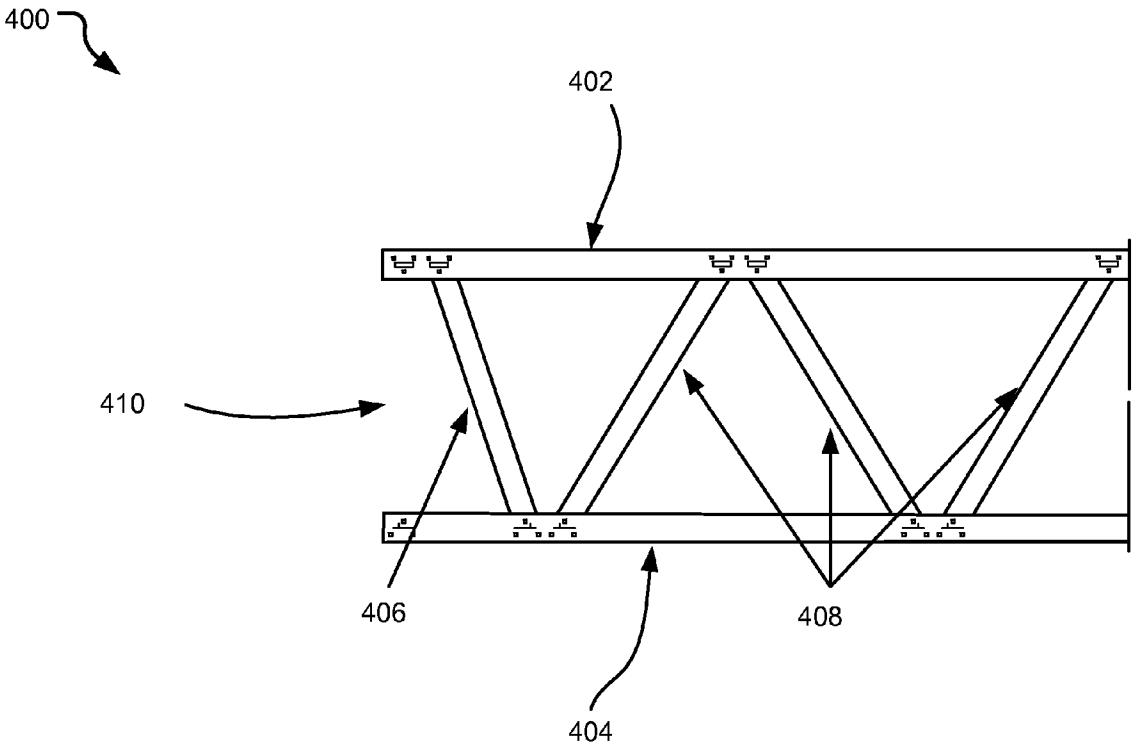
FIG. 4 illustrates an example elevation view of an example truss disclosed herein.

FIG. 4 illustrates an elevation view 400 of an example truss 410. As illustrated in FIG. 4, the truss 410 includes a top chord 402, a bottom chord 404, an exterior trace 406, and various interior traces 408. In the implementation illustrated in FIG. 4, the truss includes braces of only two lengths, with each of the interior braces 408 having the same length and each of the exterior braces 406 (only one exterior brace being shown herein) of the same length. For example, in one implementation, each of the interior braces 408 has a length of 20 inches whereas each of the exterior braces 406 has a length of 18 inches. However, in alternative implementations, these standardized brace lengths may be different.

Figure 5:
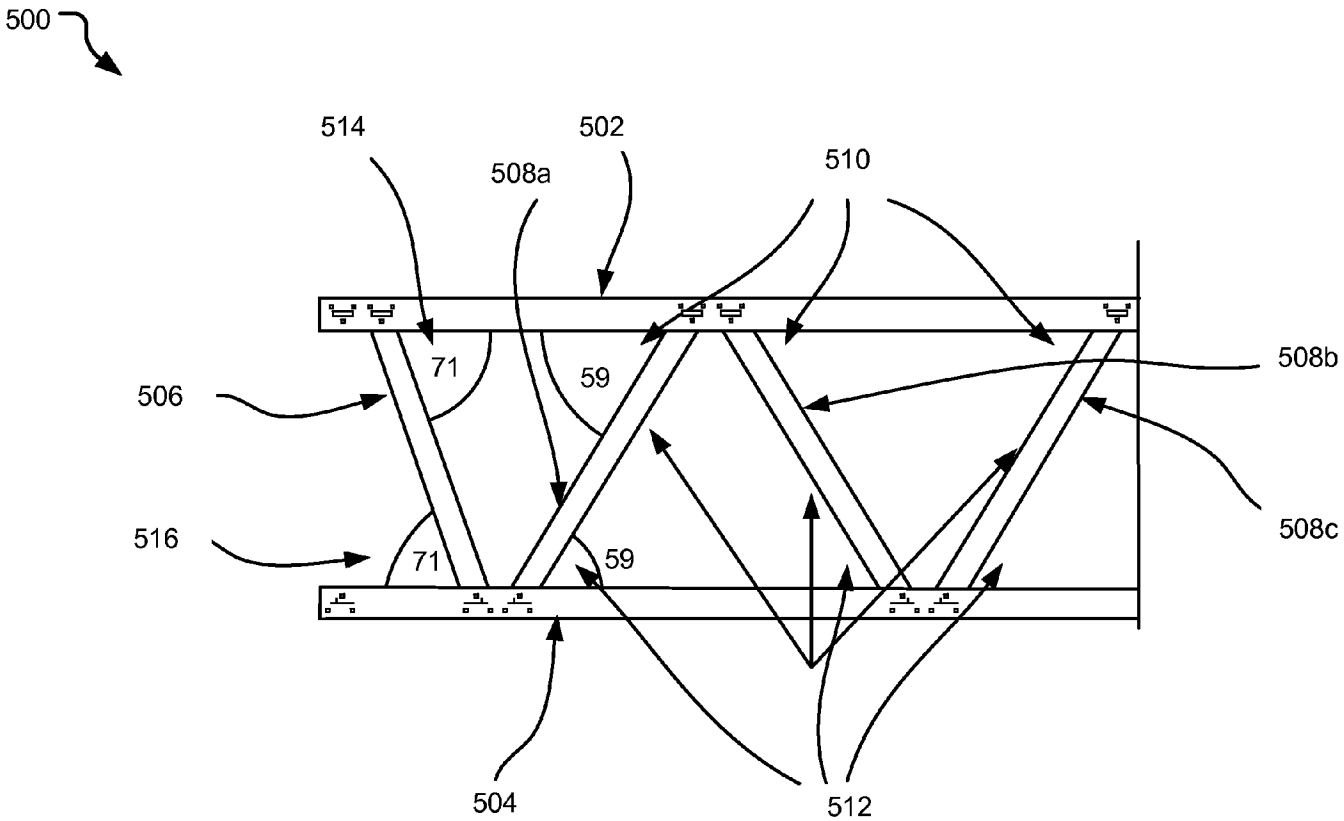
FIG. 5 illustrates an example alternative elevation view of an example truss disclosed herein.

FIG. 5 illustrates an alternative elevation view of an example truss 500. Specifically, truss 500 includes a top chord 502, a bottom chord 504, an exterior brace 506, and a plurality of interior braces 508. The alternate of the interior braces 508 are substantially parallel to each other. Thus, for example, an interior brace 508*a* is substantially parallel to an interior brace 508*c*.

Furthermore, as illustrated in FIG. 5, each of the interior braces 508 is configured to join the chords 502 and 504 at a substantially similar angle. Thus, each of the angles 510 and 512 are substantially similar. In the example implementation of FIG. 5, the angles 510 and 512 are 59 degrees. However, in an alternative implementation, other dimension of the angle 510 and 512 may be used. For example, the dimension of the angles 510 and 512 may be between 55 degrees and 65 degrees.

Similarly, each of the angles 514 and 516 between the exterior braces (Only one, 506, shown) and the top chord 502 and the bottom chord 504 is substantially similar to each other and to the angle between the other exterior brace (not shown) and the chords 502 and 504. In the illustrated implementation, each of the angles 514 and 516 is substantially equal to 71 degrees. However, in an alternative implementation, each of the angles 514 and 516 may be approximately between 65 and 75 degrees. Such standardized positioning of the braces enables quick and automated assembly of the truss 500 without requiring any measuring and re-positioning of the braces.

Figure 6:
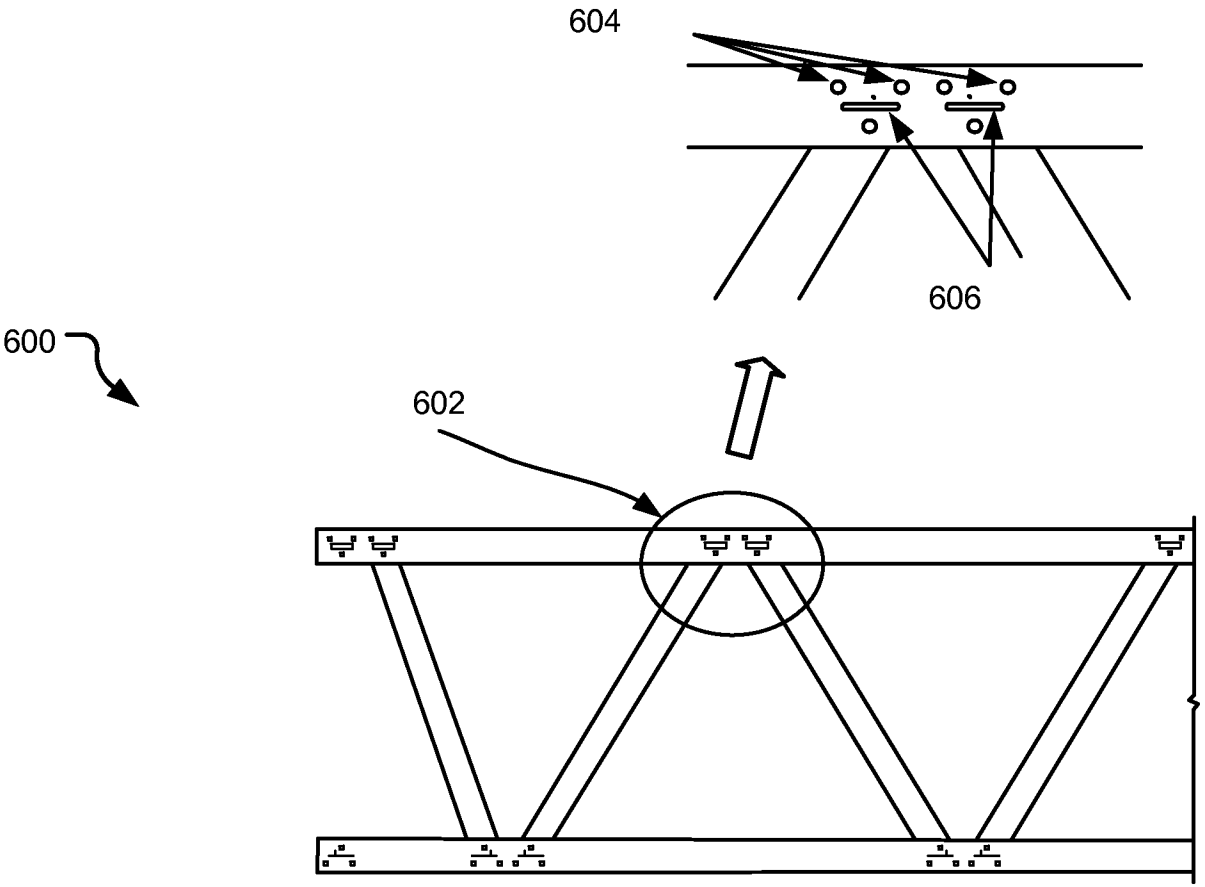
FIG. 6 illustrates an example of pilot holes and welding slots for the truss disclosed herein.

FIG. 6 illustrates an example of pilot holes and welding slots arrangement 602 for a truss 600. In this particular implementation, the braces of the truss 600 are roll formed from a 14 gauge galvanized steel roll using specialized roll formers. Such roll formers may be communicatively connected to a machine that is configured to receive a macro file with instructions for cutting the steel roll at predetermined distance and at predetermined angle so that is can be roll formed to generate the braces for the truss 600. Furthermore, such roll former machine is also configured to receive instructions from the macro file regarding placement or pouching of pilot holes 604 and welding slots 606 in chords of the truss 600. The pilot holes 604 and the welding slots 606 allow the chords to be placed in a specialized assembly jig to be connected to the braces.

Furthermore, the standardization of the punches and weld welding slots also enables computerized robotic welding of the braces to the chords. Such welded connections increases the overall strength of the truss 600 as the welded connections are stronger than light gauge material, thus eliminating failure at the point of connection between the chord and the braces. Additionally, the welded connections do not loosen like mechanical fasteners, thus adding strength to the truss 600 and eliminating any floor squeaking due to loosened fasteners. Additionally, the welded connection of the chord with the braces makes the truss stronger than a typical "C" joist or typical light gauge steel truss, thus allowing for a uniform two feet on center spacing. Such two feet on center spacing is efficient and saves on cost of construction using the truss structure.

Figure 7:
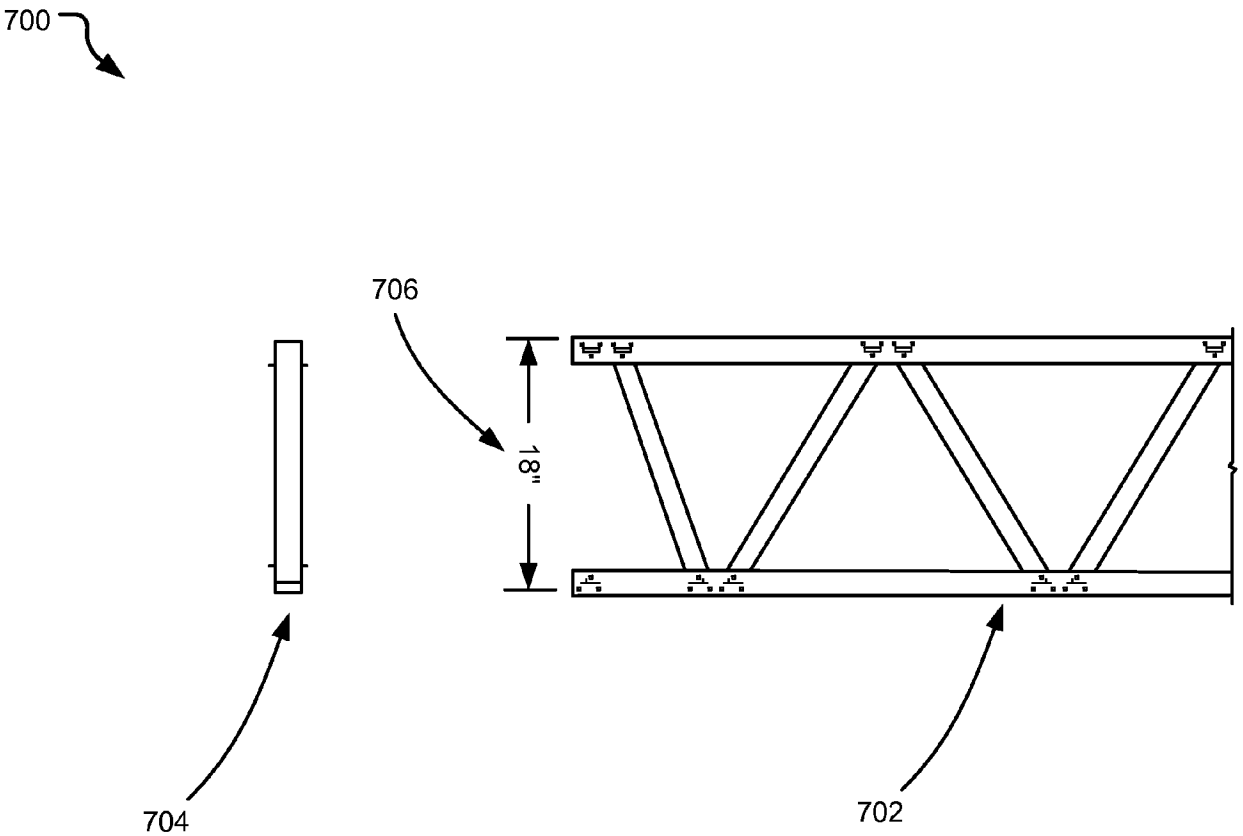
FIG. 7 illustrates example elevation and side views of the truss disclosed herein.

FIG. 7 illustrates example elevation view 702 and a side view 704 of a truss 700. In one implementation, the truss 700 may be configured in increments of two feet. In other words, each two feet of truss 700 is substantially similar in its characteristics, properties, etc. In the implementation illustrated in FIG. 7, the truss 700 has a depth of 18" as illustrated by numeral 706. Thus, the distance between the top chord and the bottom chord is such that the distance form top of the top chord to the bottom of the bottom chord us 18". This depth of the truss increases the strength of the truss and it enables better sound transfer resistance, making the floors more sound proof. Such truss configuration also increases the burn-through time of floor assembly constructed using such truss, thus providing increased fire resistance.

Figure 8:
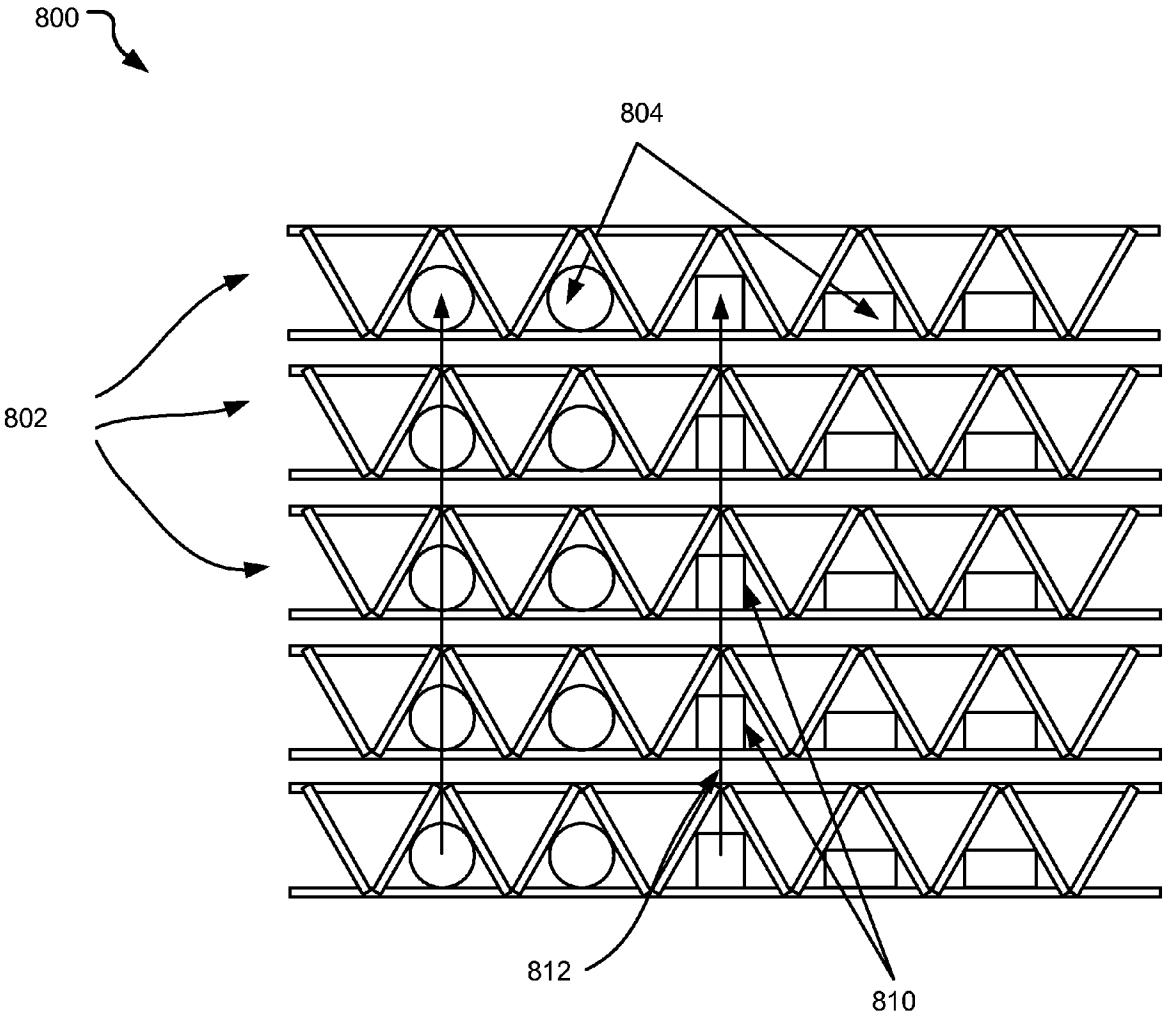
FIG. 8 illustrates an example schematic view of an arrangement of a plurality of trusses disclosed herein.
Figure 9:
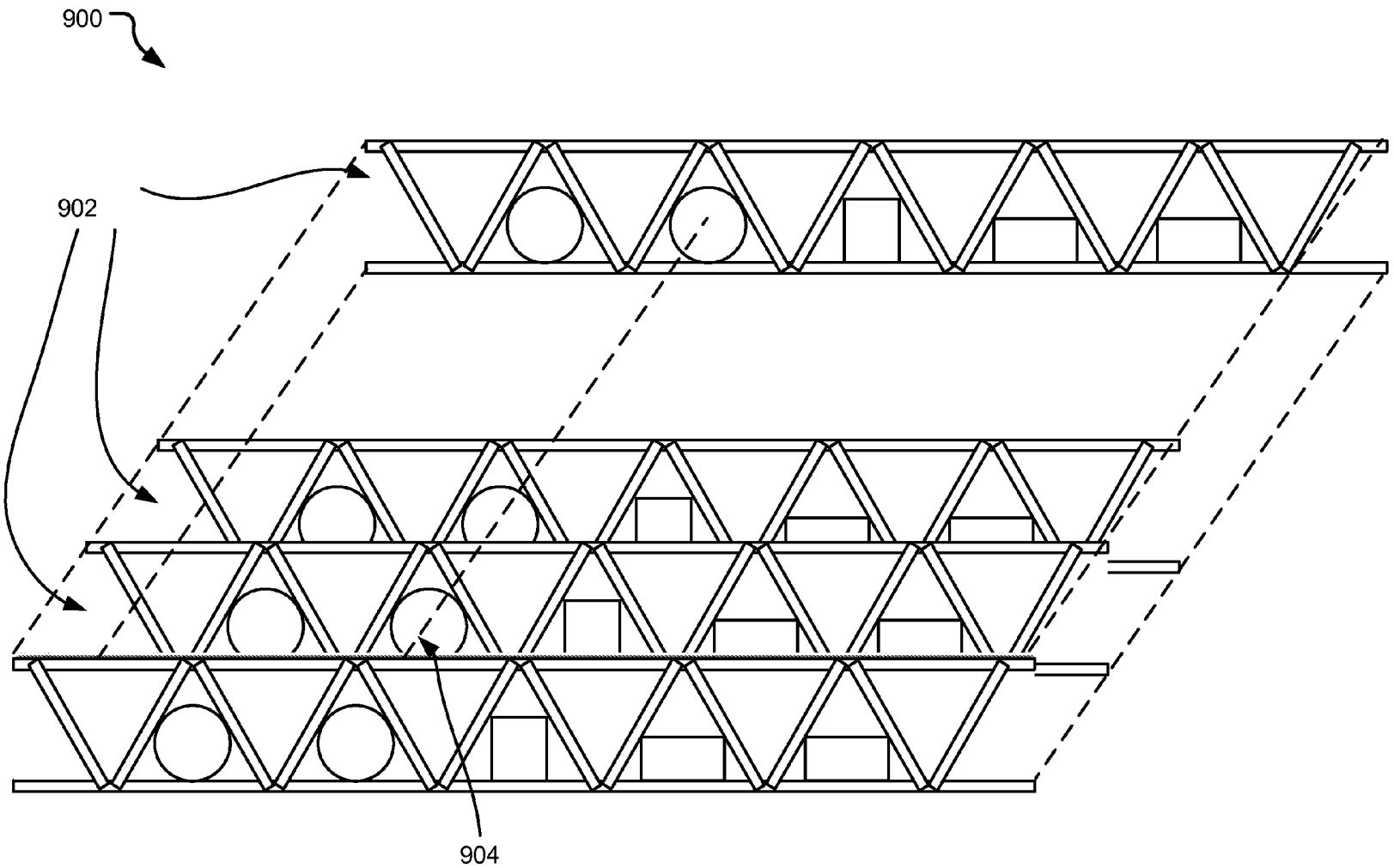
FIG. 9 illustrates an example alternative view of an arrangement of a plurality of trusses disclosed herein.

Furthermore, the uniform spacing of the braces inside the truss aligns all webbings in a floor and ceiling assembly constructed using multiple trusses, such uniform spacing allows chasing of HVAC duct work, plumbing for waste and drain pipes, electrical wiring, etc., to be run through the webbing, eliminating the needs for engineered chases. FIG. 8 illustrates a schematic view of an arrangement 800 of a plurality of trusses 802 that illustrates such chasing of the duct work 804 for various utilities, such as plumbing, pipe work, etc. Specifically, FIG. 8 illustrates that the spacing 810 between two adjacent interior braces in each of the plurality of trusses 802 is aligned along a direction perpendicular to the direction of the top chord FIG. 9 illustrates an alternative view of an arrangement 900 of a plurality of trusses 902. As illustrated in FIG. 9, ductwork 904 for various utilities can be chased through the uniform webbing provided by the various trusses.

Figure 10:
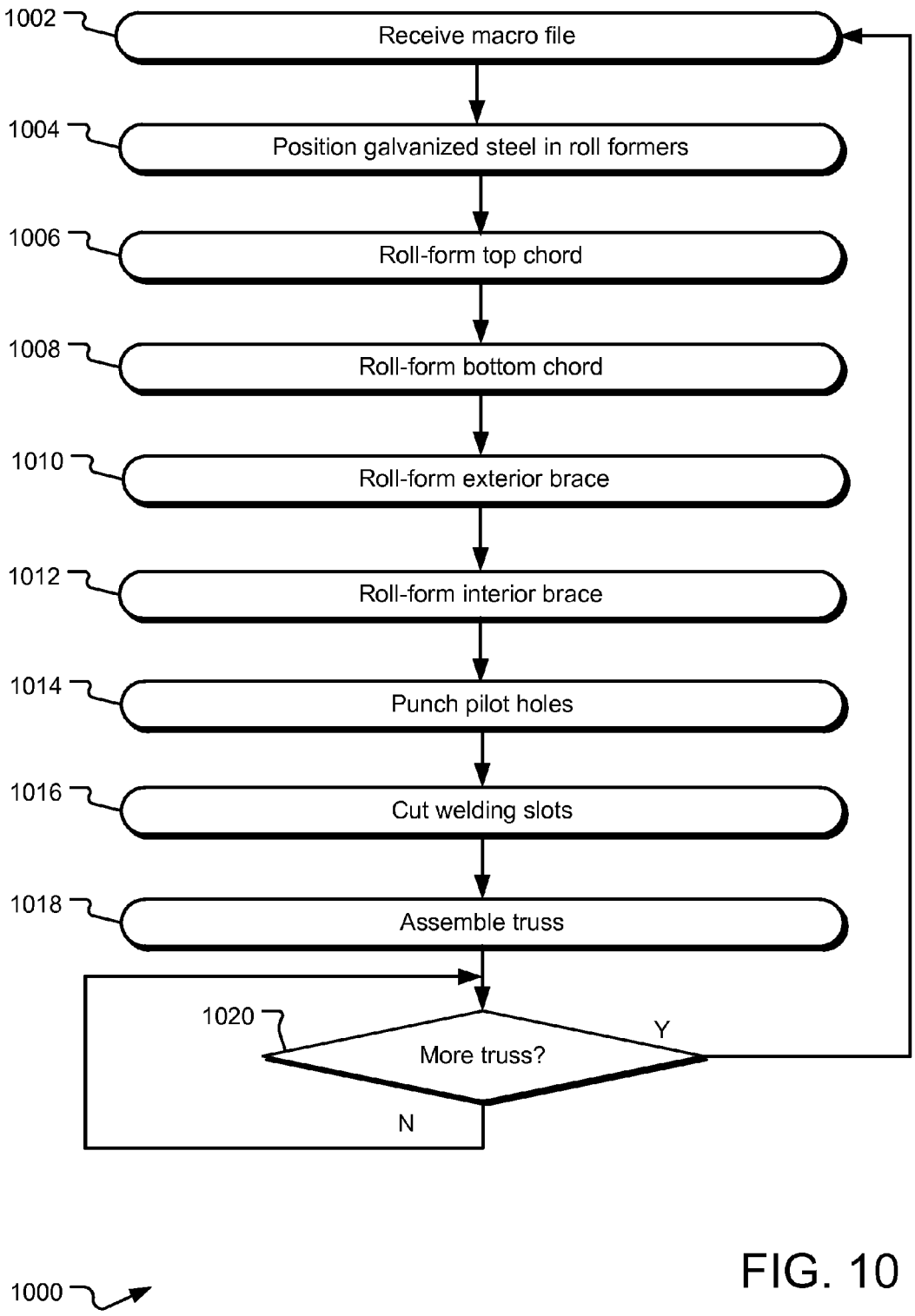
FIG. 10 illustrates an example flowchart of a process of making the truss disclosed herein.

FIG. 10 illustrates an example flowchart 1000 of a process of making the truss disclosed herein. Specifically, the flowchart 1000 illustrates various operations of an automated implementation of manufacturing trusses disclosed herein. An operation 1002 receives a macro file at a roll former machine used to generate the components of the truss. In one implementation, such macro file may be received from a software application that generates the macro file based on an architectural drawing. At operation 1004, steel rolls are positioned in the roll formers. At operation 1006, the roll formers interpret the instructions from the macro file to roll form the top chord for the truss. Subsequently, at operation 1008, the roll formers interpret the instructions from the macro file to roll form the bottom chord for the truss. Similarly, operations 1010 and 1012 roll forms the exterior braces and the interior braces for the truss as per the instructions from the macro file. Also, at operation 2014 pilot holes are punched in the top chord and the bottom chord, whereas at an operation 2016 welding slots are cut as per the instructions from the macro file. Once various parts are configured, at an operation 1018, the parts are assembled to configure the truss. An operation 1020 determines if more trusses need to be made and repeats one or more of the above operations as necessary.

The above specification, examples, and data provide a complete description of the structure and use of exemplary embodiments of the invention. Since many embodiments of the invention can be made without departing from the spirit and scope of the invention, the invention resides in the claims hereinafter appended. Furthermore, structural features of the different embodiments may be combined in yet another embodiment without departing from the recited claims. Although the present invention has been described with reference to preferred embodiments, workers skilled in the art will recognize that changes may be made in form and detail without departing from the scope of the invention. The implementations described above and other implementations are within the scope of the following claims.

What is claimed is:

1. A truss, comprising:

a top chord;

a bottom chord;

a plurality of exterior braces, wherein a length of each of the plurality of exterior braces is substantially alike and wherein the angle between each of the exterior braces and the top chord is substantially alike; and a plurality of interior braces, wherein a length of each of the plurality of interior braces is substantially alike, wherein the top chord further comprises a plurality of welding slots arrangements, each of the welding slots arrangements including pilot holes and welding slots, wherein the welding slots arrangement is used to securely attach one of the interior braces and the exterior braces to the top chord.

2. The truss of claim 1, wherein alternate of the interior braces are parallel to each of other.

3. The truss of claim 2, wherein an angle between each of the alternate interior braces parallel to each other and the top chord is substantially alike.

4. The truss of claim 2, wherein an angle between each of the alternate interior braces parallel to each other and the top chord is substantially fifty nine (59) degrees.

5. The truss of claim 1, wherein an angle between the exterior braces and the top chord is substantially fifty nine (59) degrees.

6. The truss of claim 1, wherein the bottom chord comprises:

a first flange having an inner end and an outer end with a first lip at the inner end of the first flange;

a second flange having an inner end and an outer end with a second lip at the inner end of the second flange; and a web connected to the outer end of the first flange and the outer end of the second flange and extending between the first flange and the second flange.

7. The truss of claim 1, wherein the top chord comprises:

a first flange having an inner end and an outer end with a first lip at the inner end of the first flange;

a second flange having an inner end and an outer end with a second lip at the inner end of the second flange; and a web connected to the outer end of the first flange and the outer end of the second flange and extending between the first flange and the second flange.

8. The truss of claim 1, wherein each of the interior braces and the exterior braces is welded to the top chord using the welding slots.

9. The truss of claim 1 wherein a width of the interior trusses is less than a width of each of the top chord and the bottom chord.

10. A truss configuration, comprising:

a plurality of trusses, each of the plurality of trusses comprising a top chord, a bottom chord, a plurality of exterior braces, and a plurality of interior braces, wherein the top chord of the each of the plurality of trusses are located parallel to each other in a same planar level and the bottom chord of the each of the plurality of trusses are located parallel to each other in a same planar level, wherein the top chord further comprises a plurality of welding slots arrangements, each of the welding slots arrangements including pilot holes and welding slots, wherein the welding slots arrangement is used to securely attach one of the interior braces and the exterior braces to the top chord.

11. The truss configuration of claim 10, wherein a length of each of the plurality of exterior braces in each of the plurality of trusses is substantially alike.

12. The truss configuration of claim 10, wherein a spacing between two adjacent interior braces in each of the plurality of trusses is aligned along a direction substantially perpendicular to the direction of the top chords of the each of the plurality of trusses.

13. A chord for a truss, the chord comprising:

a first flange having an inner end and an outer end with a first lip at the inner end of the first flange;

a second flange having an inner end and an outer end with a second lip at the inner end of the second flange; and a web connected to the outer end of the first flange and the outer end of the second flange and extending between the first flange and the second flange, wherein the chord further comprises a plurality of welding slots arrangements, each of the welding slots arrangements including pilot holes and welding slots, wherein the welding slots arrangement is used to securely attach one of an interior brace and an exterior brace to the chord.

14. The chord of claim 13, used as a bottom chord of a truss, wherein the inner end of the flanges faces the inside of the truss.

15. The chord of claim 13, wherein a thickness of the lip is substantially equal to 0.25 inch.

16. The chord of claim 13, wherein a width of the web is substantially equal to two inches.

* * * * *